US007309034B2

(12) United States Patent
Huang

(10) Patent No.: US 7,309,034 B2
(45) Date of Patent: Dec. 18, 2007

(54) AIR NOZZLE WITH A CENTRAL TUBE MOVABLY RECEIVED THEREIN TO ADAPT TO VARIOUS POSITIONS OF A PIN IN AN OBJECT TO BE INFLATED

(76) Inventor: Ying-Che Huang, No. 111, Lane Tzengfu, Tzengtsuo Tsuen, Shioushuei Shiang, Changhua (TW)

( * ) Notice: Subject to any disclaimer, the term of this patent is extended or adjusted under 35 U.S.C. 154(b) by 442 days.

(21) Appl. No.: 11/136,396

(22) Filed: May 25, 2005

(65) Prior Publication Data

US 2006/0269638 A1 Nov. 30, 2006

(51) Int. Cl.
*A62C 31/02* (2006.01)
*B05B 1/28* (2006.01)
*B05B 15/08* (2006.01)

(52) U.S. Cl. ..... 239/589; 239/290; 239/291; 239/293; 239/300; 239/301; 239/600; 239/587.1

(58) Field of Classification Search ..... 239/589, 239/290, 291, 293, 300, 301, 600, 587.1
See application file for complete search history.

(56) References Cited

U.S. PATENT DOCUMENTS 4,925,101 A * 5/1990 Konieczynski et al. ..... 239/8
5,322,221 A * 6/1994 Anderson ..... 239/291
5,454,517 A * 10/1995 Naemura ..... 239/390
5,687,913 A * 11/1997 Robisch et al. ..... 239/346
6,267,301 B1 * 7/2001 Haruch ..... 239/290
6,612,506 B1 * 9/2003 Huang ..... 239/291

* cited by examiner

*Primary Examiner*—Davis D. Hwu
(74) *Attorney, Agent, or Firm*—Rabin & Berdo, P.C.

(57) ABSTRACT

An air nozzle includes a hollow casing, a plug received in the chamber and having a channel defined through the plug, a central tube movably received inside the channel of the plug and having an outer threading formed on an outer periphery thereof, a nozzle rotatably received inside the chamber and having a nose out of the top open end of the hollow casing and a compartment to receive therein the central tube and the plug and a cap to secure the nozzle, the central tube and the plug inside the hollow casing such that movement of the central tube allows the air nozzle to adapt to various positions of a central pin of a second air nozzle in an object for inflation.

20 Claims, 10 Drawing Sheets

AIR NOZZLE WITH A CENTRAL TUBE MOVABLY RECEIVED THEREIN TO ADAPT TO VARIOUS POSITIONS OF A PIN IN AN OBJECT TO BE INFLATED

BACKGROUND OF THE INVENTION

1. Field of the Invention

The present invention relates to an air nozzle, and more particularly to an air nozzle having a central tube movably received therein so as to adapt to various positions of a pin in an object to be inflated.

2. Description of Related Art

With reference to FIG. 10, a conventional air nozzle is shown and includes a hollow casing A having two open ends, a sleeve D received inside the hollow casing A, a plug C received inside the sleeve D and a central tube E securely received inside the plug C. A cap B having a central passage (not numbered) is then provided to engage with an inner periphery of one of the two open ends of the hollow casing A.

When the conventional air nozzle is used, the first end E1 of the central tube E is connected to an air hose which in turn connects to an air pumping device and the second end E2 of the central tube E is to be adapted to connect to a pin in an object to be inflated. It is to be noted that the pin in the object to be inflated is firmly and fixedly mounted inside the object and immovable relative to the object. Therefore, only when the central tube E is able to connect to the pin in the object, can the air pumping device pump air into the object to be inflated. That is, if the pin in the object extends out of the object, the central tube E does engage with the pin. However, because the central tube E engages with the pin too early, air leakage occurs even before the air pumping device starts operation. However, when the pin is retracted inside the object, it is impossible for the central tube E to engage with the pin such that inflation to the object cannot be completed. As a matter of fact, the conventional air nozzle as shown can only be applied to a certain type of object for inflation due to different positions of the pin in the object.

To overcome the aforementioned disadvantages, the present invention tends to provide an improved air nozzle to obviate the aforementioned disadvantages.

SUMMARY OF THE INVENTION

The primary objective of the present invention is to provide an improved air nozzle able to adapt to different pin positions inside an object to be inflated.

From one aspect of the present invention, the air nozzle of the invention has a central tube movably received therein so as to adapt to different positions of the pin in the object to be inflated.

Other objects, advantages and novel features of the invention will become more apparent from the following detailed description when taken in conjunction with the accompanying drawings.

DETAILED DESCRIPTION OF PREFERRED EMBODIMENTS

Figure 1:
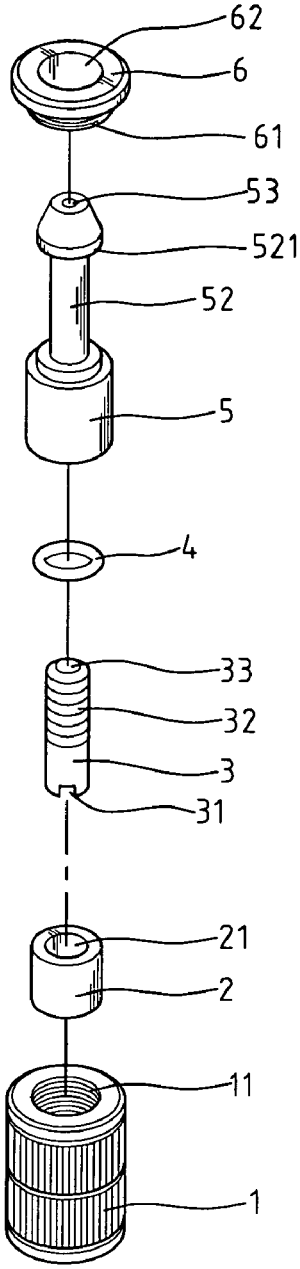
FIG. 1 is an exploded perspective view of the air nozzle of the present invention.
Figure 2:
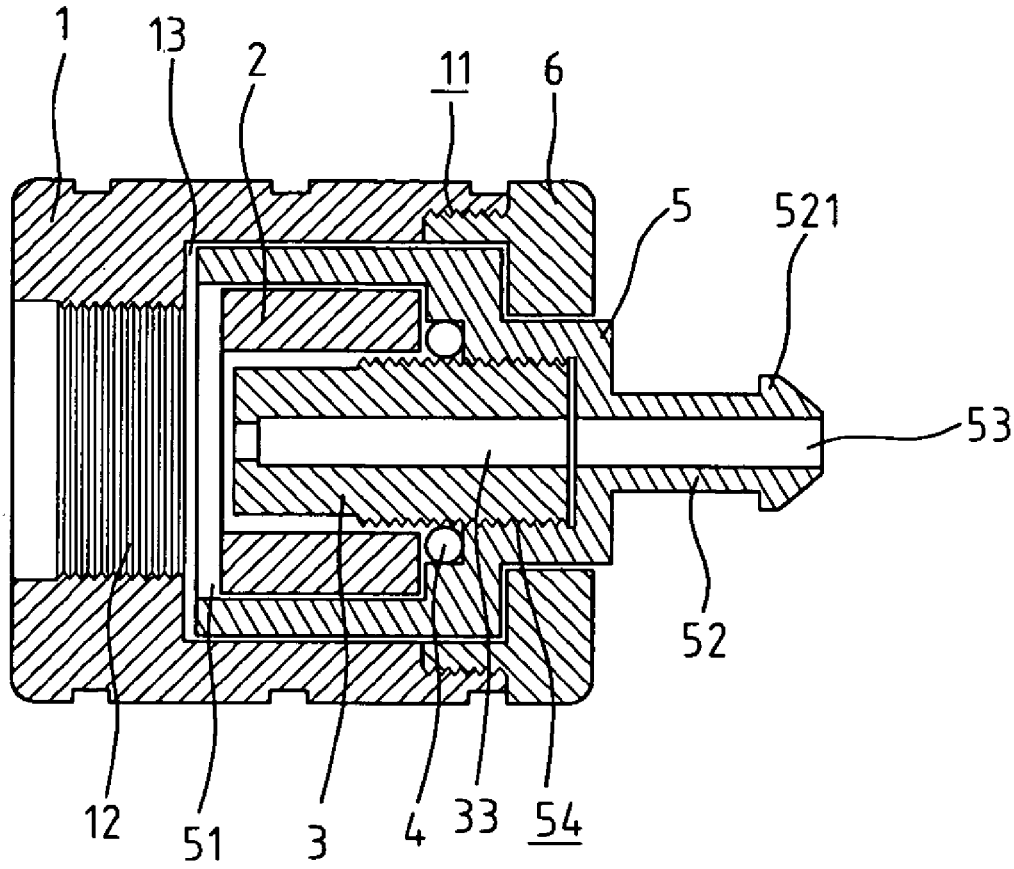
FIG. 2 is a cross-sectional view showing the interconnection of components of the air nozzle of the present invention.

With reference to FIGS. 1 and 2, an air nozzle in accordance with the present invention includes a hollow casing 1, a plug 2, a central tube 3, a seal 4, a nozzle 5 and a cap 6. The hollow casing 1 has a top open end provided with an outer threading 11, a bottom open end opposing the top open end and provided with an inner threading 12 and a chamber 13 formed inside the hollow casing 1. The plug 2 has a centrally defined channel 21. The central tube 3 has a cutout 31 defined in a bottom end thereof, an outer threading 32 formed on an outer periphery thereof and a passage 33 defined through the central tube 3.

The nozzle 5 is provided with a compartment 51 defined inside the nozzle 5, a nose 52 formed on a top end thereof and having an inlet 53 defined through the nose 52 to communicate with the compartment 51 and an internal threading 54 formed on an inner periphery of the nozzle 5. Preferably, the seal 4 is made of rubber and has an inner diameter smaller than an outer diameter of the central tube 3. The seal 4 is received in the compartment 51 of the nozzle 5. The cap 6 has a hole 62 and an outer threading 61 formed on an outer periphery of the cap 6.

When the air nozzle of the present invention is assembled, it is noted that the seal 4 is first placed inside the compartment 51 of the nozzle 5 and the central tube 3 is inserted into the nozzle 5 to allow the outer threading 32 of the central tube 3 to combine with the inner threading 54 of the nozzle 5. While the central tube 3 is inserted into the nozzle 5, the seal 4 is then mounted around the central tube 3. Thereafter the plug 2 is inserted into the compartment 51 to have the central tube 3 received in the channel 21. Then the combination of the plug 2, the central tube 3, the seal 4 and the nozzle 5 is placed into the chamber 13 of the hollow casing 1. Last the outer threading 61 of the cap 6 is combined with the inner threading 11 of the hollow casing 1 to secure the combination of the plug 2, the central tube 3, the seal 4 and the nozzle 5 inside the chamber 13 of the hollow casing 1. However, it is to be noted that after the combination of the plug 2, the central tube 3, the seal 4, and the nozzle 5 is secured inside the chamber 13, the nozzle 5 is loosely fitted inside the chamber 13. That is, a space is defined between a distal end of the nozzle 5 and a bottom face of the chamber 13 to allow the nozzle 5 to be rotatably and movably received inside the chamber 13.

Figure 3:
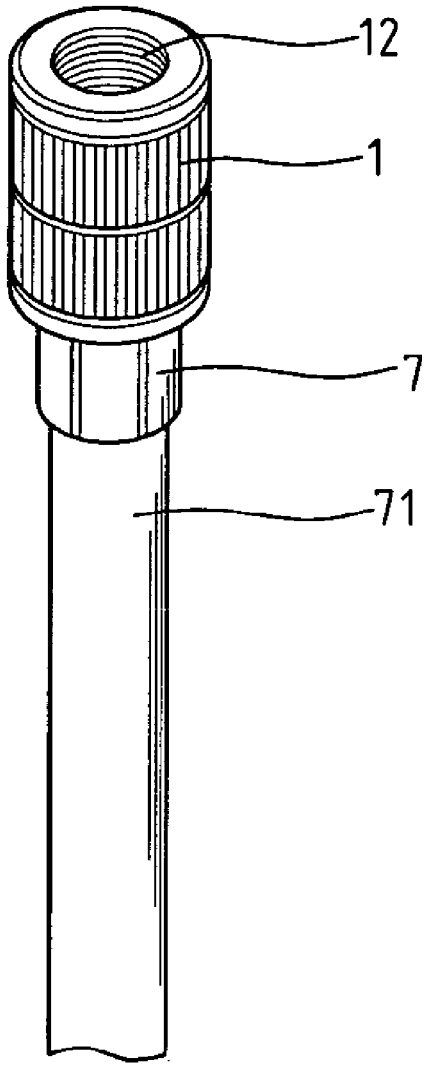
FIG. 3 is a perspective view of the combined air nozzle of the present invention.
Figure 4:
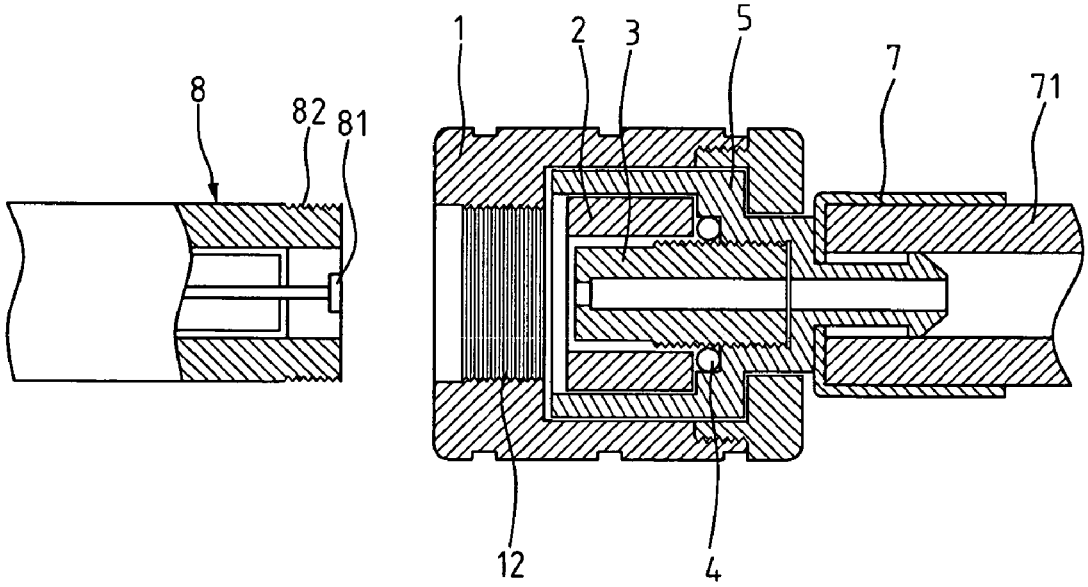
FIG. 4 is schematic cross-sectional view showing the application of the air nozzle of the present invention.

With reference to FIGS. 3 and 4, after the assembly of the air nozzle of the present invention, a sleeve 7 is mounted on the proximal end of the nozzle 5. The proximal end of the nozzle 5 is provided with a wedge 521 to facilitate combination with the sleeve 7. Thereafter, a hose 71 is connected to the sleeve 7 and extends to an air supply device (not shown). When the air nozzle of the present invention is in use together with the sleeve 7 and the hose 71 connected to the air nozzle, it is noted that an outer threading 82 of a second air nozzle 8 mounted on an object to be inflated is threadingly connected to the inner threading 12 of the casing 1.

Figure 5:
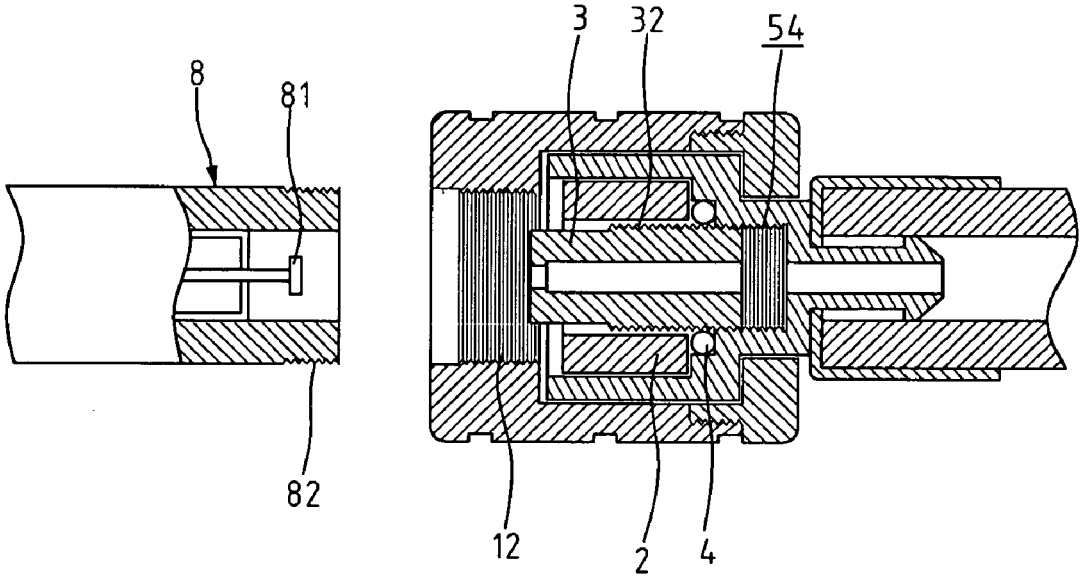
FIG. 5 is a schematic cross-sectional view showing movement of the central tube of the air nozzle of the present invention.

A central pin 81 in the second air nozzle is flush with a proximal end face of the second air nozzle 8. In order to have appropriate engagement between the central pin 81 and the central tube 3 of the air nozzle of the present invention, an auxiliary tool such as a screwdriver is employed to extend into the cutout 31 to drive the central tube 3 to move inside the compartment 51 of the nozzle 5. That is the central tube 3 is moved away from the central pin 81 so as to allow the outer threading 82 to threadingly connect to the inner threading 12 of the hollow casing 1. However, when the central pin 81 is retracted inside the second air nozzle 8, as shown in FIG. 5, the central tube 3 may be driven to move toward the central pin 81 inside the compartment 51 such that after the combination between the second air nozzle 8 and the hollow casing 1, the engagement between the central tube 3 and the central pin 81 is appropriate.

Figure 6:
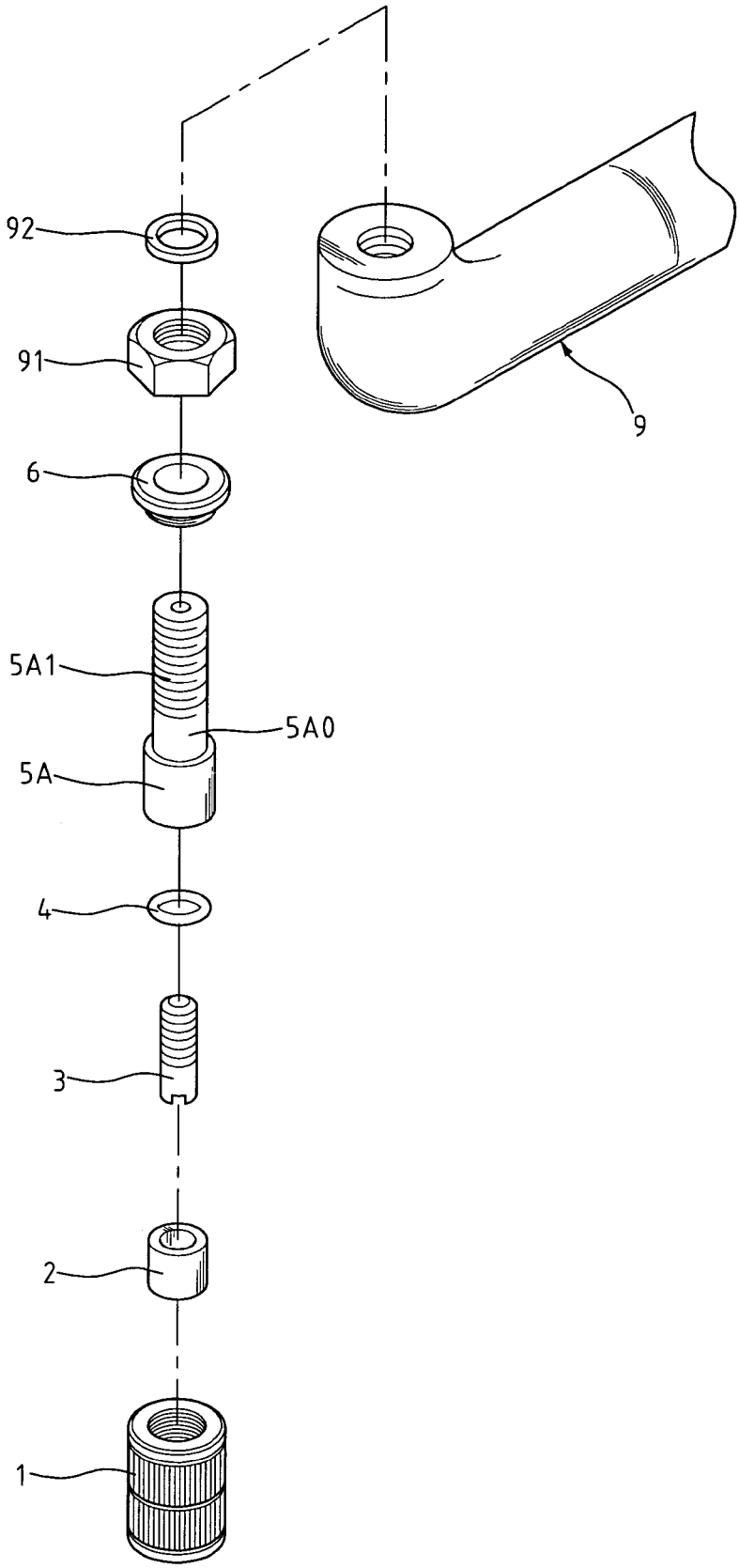
FIG. 6 an exploded perspective view of a second embodiment of the air nozzle of the present invention.
Figure 7:
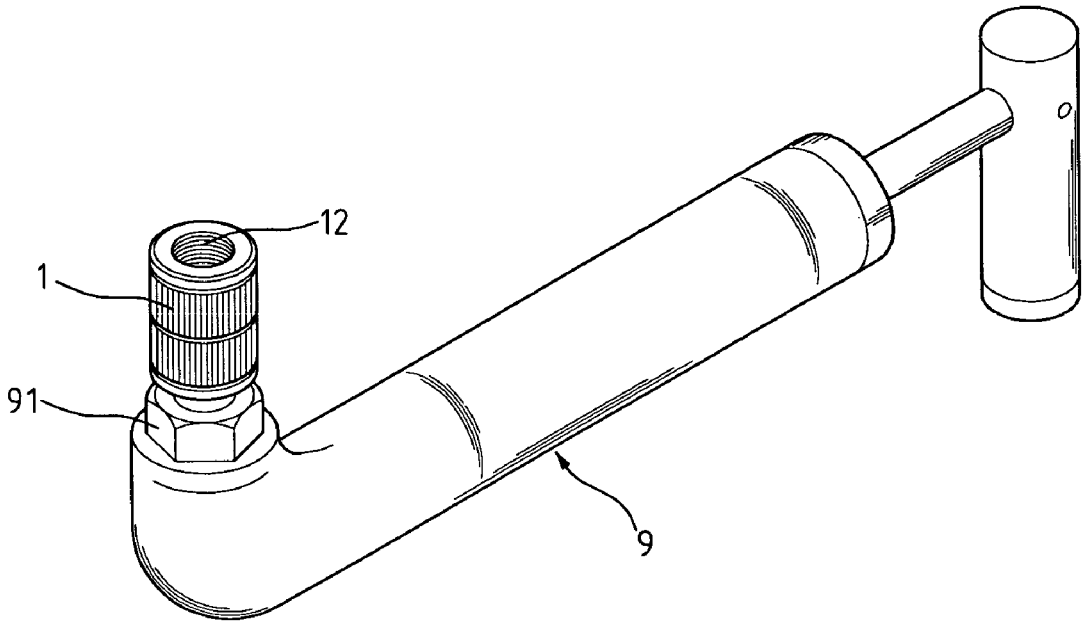
FIG. 7 is a perspective view showing the combined air nozzle of the second embodiment of the present invention.
Figure 8:
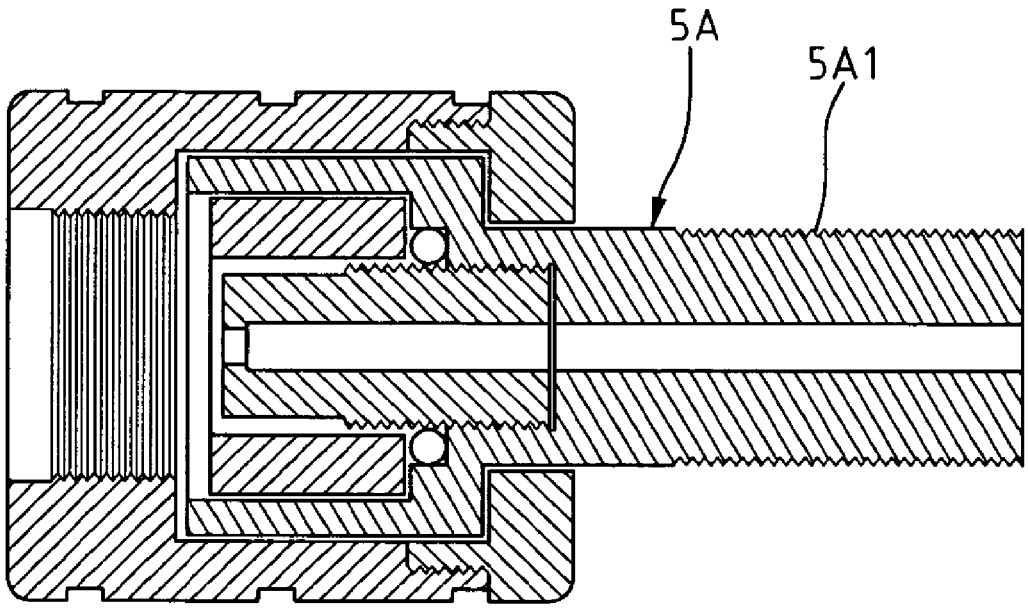
FIG. 8 is a cross-sectional view of the second embodiment of the air nozzle of the present invention.

With reference to FIGS. 6 to 8, a second embodiment of the present invention is shown. The components of the second embodiment are mostly the same as those shown in the first embodiment. The only difference is the nozzle 5A. The nose 5A0 of the nozzle 5A is provided with an outer threading 5A1 formed on an outer periphery of the nose 5A0.

Figure 9:
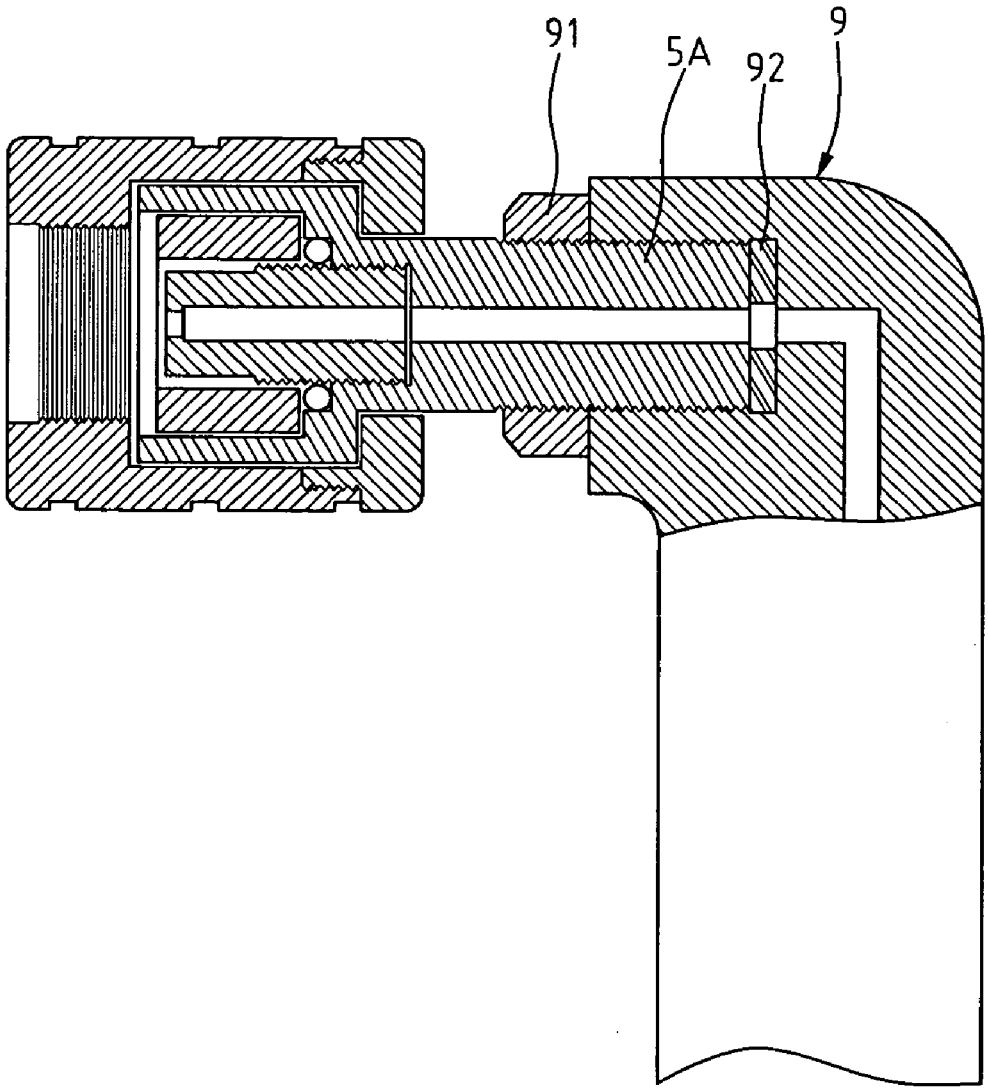
FIG. 9 is a schematic cross-sectional view showing the application of the air nozzle of the second embodiment of the present invention.
Figure 10:
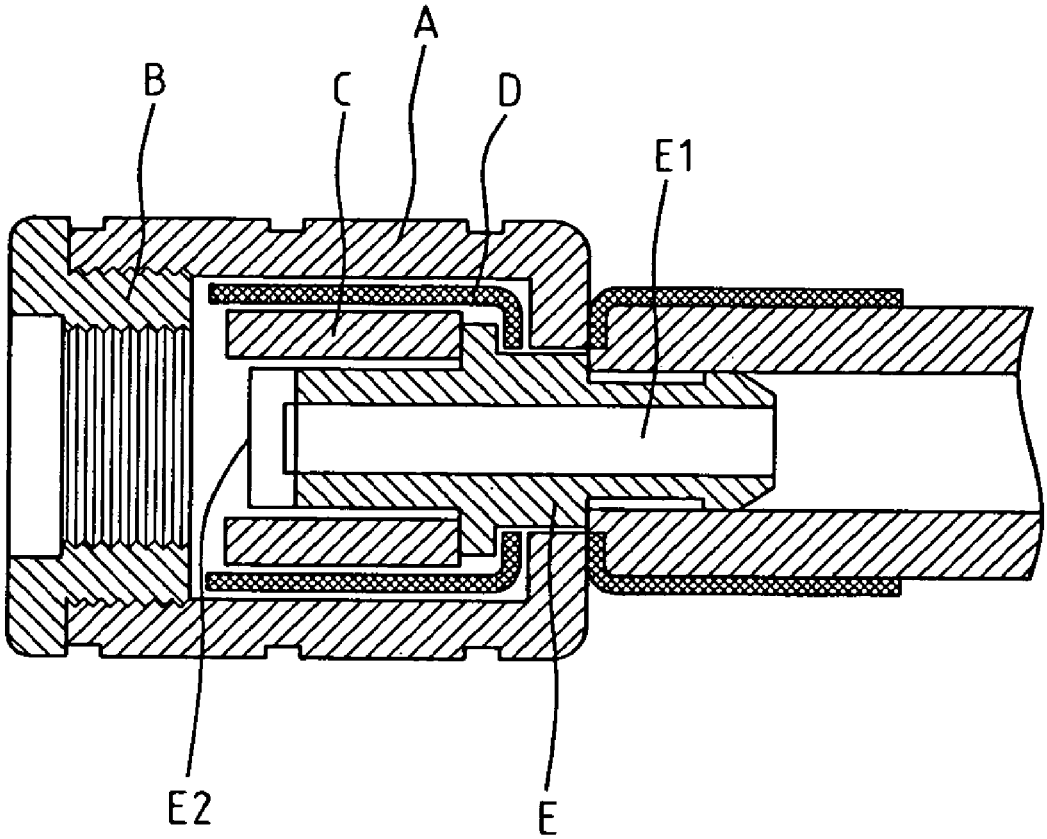
FIG. 10 PRIOR ART
FIG. 10 is a cross-sectional view of a conventional air nozzle.

With reference to FIG. 9, it is noted that with the provision of the outer threading 5A1, a nut 91 is able to be threadingly mounted around the nose 5A0 and then the outer threading 5A1 is able to be connected to an inner threading (not numbered) of a second air nozzle from an air pump 9 after an annular ring 92 is abutted against a distal end of the nose 5A0. The application of the second embodiment is the same as that of the first embodiment such that detailed description concerning the adjustment of the position change of the central tube 3 is omitted for simplicity.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An air nozzle comprising:

a hollow casing having a top open end, a bottom open end communicating with the top open end and a chamber through which the top open end communicates with the bottom open end;

a plug received in the chamber and having a channel defined through the plug;

a central tube movably received inside the channel of the plug and having an outer threading formed on an outer periphery thereof;

a nozzle rotatably received inside the chamber of the hollow casing and having a nose extending out of the top open end of the hollow casing for connection with a hose from an air supply device and a compartment to receive therein the central tube and the plug; and a cap securely engaged with the top open end of the hollow casing to secure the nozzle, the central tube and the plug inside the chamber of the hollow casing such that movement of the central tube allows the air nozzle to adapt to various positions of a central pin of a second air nozzle in an object to be inflated.

2. The air nozzle as claimed in claim 1, wherein the top open end has a first inner threading formed on an inner periphery of the hollow casing to correspond to and combine with an outer threading on the cap so as to secure the nozzle, the central tube and the plug inside the chamber of the hollow casing.

3. The air nozzle as claimed in claim 1, wherein the central tube has an outer threading formed on an outer periphery thereof to correspond to and combine with an inner threading formed on an inner face of the nozzle.

4. The air nozzle as claimed in claim 2, wherein the central tube has an outer threading formed on an outer periphery thereof to correspond to and combine with an inner threading which is formed on an inner face of a compartment defined inside the nozzle.

5. The air nozzle as claimed in claim 1, wherein the central tube has a cutout defined in a bottom end thereof thereby allowing a tool to drive the central tube to move inside the compartment of the nozzle.

6. The air nozzle as claimed in claim 2, wherein the central tube has a cutout defined in a bottom end thereof thereby allowing a tool to drive the central tube to move inside the compartment of the nozzle.

7. The air nozzle as claimed in claim 3, wherein the central tube has a cutout defined in a bottom end thereof thereby allowing a tool to drive the central tube to move inside the compartment of the nozzle.

8. The air nozzle as claimed in claim 4, wherein the central tube has a cutout defined in a bottom end thereof thereby allowing a tool to drive the central tube to move inside the compartment of the nozzle.

9. The air nozzle as claimed in claim 1 further comprising a seal mounted around the central tube so as to have an air tight engagement with the nozzle after the central tube is received in the compartment of the nozzle.

10. The air nozzle as claimed in claim 2 further comprising a seal mounted around the central tube so as to have an air tight engagement with the nozzle after the central tube is received in the compartment of the nozzle.

11. The air nozzle as claimed in claim 3 further comprising a seal mounted around the central tube so as to have an air tight engagement with the nozzle after the central tube is received in the compartment of the nozzle.

12. The air nozzle as claimed in claim 4 further comprising a seal mounted around the central tube so as to have an air tight engagement with the nozzle after the central tube is received in the compartment of the nozzle.

13. The air nozzle as claimed in claim 5 further comprising a seal mounted around the central tube so as to have an air tight engagement with the nozzle after the central tube is received in the compartment of the nozzle.

14. The air nozzle as claimed in claim 6 further comprising a seal mounted around the central tube so as to have an air tight engagement with the nozzle after the central tube is received in the compartment of the nozzle.

15. The air nozzle as claimed in claim 7 further comprising a seal mounted around the central tube so as to have an air tight engagement with the nozzle after the central tube is received in the compartment of the nozzle.

16. The air nozzle as claimed in claim 8 further comprising a seal mounted around the central tube so as to have an air tight engagement with the nozzle after the central tube is received in the compartment of the nozzle.

17. The air nozzle as claimed in claim 13, wherein the nose further has an outer threading for connection with a nut from an air supply device.

18. The air nozzle as claimed in claim 14, wherein the nose further has an outer threading for connection with a nut from an air supply device.

19. The air nozzle as claimed in claim 15, wherein the nose further has an outer threading for connection with a nut from an air supply device.

20. The air nozzle as claimed in claim 16, wherein the nose further has an outer threading for connection with a nut from an air supply device.

* * * * *